US008416048B2

(12) United States Patent
Tawa

(10) Patent No.: US 8,416,048 B2
(45) Date of Patent: Apr. 9, 2013

(54) ELECTRONIC COMPONENT

(75) Inventor: Katsunori Tawa, Shiga-ken (JP)

(73) Assignee: Murata Manufacturing Co., Ltd. (JP)

( * ) Notice: Subject to any disclaimer, the term of this patent is extended or adjusted under 35 U.S.C. 154(b) by 204 days.

(21) Appl. No.: 12/797,174

(22) Filed: Jun. 9, 2010

(65) Prior Publication Data

US 2010/0328009 A1 Dec. 30, 2010

(30) Foreign Application Priority Data

Jun. 25, 2009 (JP) ..... 2009-150418

(51) Int. Cl.
*H01F 5/00* (2006.01)
*H01F 27/28* (2006.01)

(52) U.S. Cl. ..... 336/200; 336/232

(58) Field of Classification Search ..... 336/200, 336/232

See application file for complete search history.

(56) References Cited

U.S. PATENT DOCUMENTS

| | | | | |
|---|---|---|---|---|
| 6,211,767 | B1 * | 4/2001 | Jitaru | 336/200 |
| 6,498,555 | B1 * | 12/2002 | Sakata | 336/200 |
| 2009/0153282 | A1 | 6/2009 | Taoka et al. | |

FOREIGN PATENT DOCUMENTS

| | | | |
|---|---|---|---|
| EP | 1916678 | A1 * | 4/2008 |
| JP | 11-265823 | | 9/1999 |
| JP | 11265823 | A * | 9/1999 |
| JP | 2002-260925 | A | 9/2002 |
| JP | 2006-042097 | A | 2/2006 |
| JP | 2006-066829 | A | 3/2006 |
| JP | 2006-352568 | A | 12/2006 |
| JP | 2007-134555 | A | 5/2007 |
| JP | 2008-109240 | A | 5/2008 |

OTHER PUBLICATIONS

The Office Action issued from the German Patent and Trademark Office on Sep. 8, 2012; German Patent Application No. 10 2010 030 348.8.

* cited by examiner

*Primary Examiner* — Mohamad Musleh
*Assistant Examiner* — Tsz Chan
(74) *Attorney, Agent, or Firm* — Studebaker & Brackett PC; Tim L. Brackett, Jr.; John F. Guay

(57) ABSTRACT

An electronic component includes overlapping coils in a rectangular laminate to form a substantially annular orbit. The orbit passes about an intersection of diagonal lines of an insulator layer of the laminate and is divided into a first orbit portion and a second orbit portion by a straight line parallel to a short side of the insulator layer. When an orbit obtained by the axisymmetric movement of the first orbit portion relative to the straight line is defined as a third orbit portion, a part of the second orbit portion overlaps with a part of the third orbit portion, and the non overlapped portion of the second orbit portion is positioned closer to the intersection than the non overlapped portion of the third orbit portion. A via hole conductor is provided in a region outboard an outer side of the non overlapping portion of the second orbit portion and inboard an outer side of the non overlapping portion of the third orbit portion.

10 Claims, 6 Drawing Sheets

ELECTRONIC COMPONENT

CROSS REFERENCE TO RELATED APPLICATIONS

The present application claims priority to Japanese Patent Application No. JP 2009-150418, filed Jun. 25, 2009, the entire contents of which are incorporated herein by reference in their entirety.

BACKGROUND

1. Field of the Invention

The present invention relates to an electronic component, and more particularly, relates to an electronic component containing a coil.

2. Description of the Related Art Japanese Unexamined Patent Application Publication No. 2002-260925 (the '925 application) describes a known multilayer chip inductor. FIG. 9 is a perspective view of a multilayer chip inductor 500 described in the '925 application.

The multilayer chip inductor 500 has a laminate 502, external electrodes 504*a* and 504*b*, via hole conductors 506*a* and 506*b*, and a coil L as shown in FIG. 9. The laminate 502 is obtained by laminating insulator layers and contains the coil L. The coil L is a spiral coil having a coil axis extending in the lamination direction (vertical direction of FIG. 9). The external electrodes 504*a* and 504*b* are provided on the bottom surface of the laminate 502. The via hole conductors 506*a* and 506*b* each are provided in such a manner as to extend in the lamination direction while being exposed to the side surfaces of the laminate 502, and connect the ends of the coil L and the external electrodes 504*a* and 504*b*.

Here, the via hole conductors 506*a* and 506*b* will be described in detail. The via hole conductors 506*a* and 506*b* form a semi-circular shape when viewed in plan view in the lamination direction. This is because the via hole conductors 506*a* and 506*b* are formed by dividing a substantially cylindrical via hole conductor extending in the lamination direction into two parts. More specifically, when a mother laminate is cut into separate laminates 502, a via hole conductor formed extending over two laminates 502 is divided into two via hole conductors.

In the multilayer chip inductor 500, the diameter of the coil L can be enlarged, and thus a high inductance value can be achieved. In more detail, the via hole conductors 506*a* and 506*b* are provided in such a manner as to be exposed to the side surfaces of the laminate 502. Thus, in the multilayer chip inductor 500, an area where the coil L can be formed becomes large compared with the case where the via hole conductors 506*a* and 506*b* are formed in the laminate 502. Thus, in the multilayer chip inductor 500, the diameter of the coil L can be enlarged, and thus a high inductance value can be obtained.

However, the multilayer chip inductor 500 has a problem in that the resistance value between the external electrodes 504*a* and 504*b* varies as described later. In more detail, the coil L is connected to the external electrodes 504*a* and 504*b* through the via hole conductors 506*a* and 506*b*, respectively. The via hole conductors 506*a* and 506*b* are formed by dividing a substantially cylindrical via hole conductor into two parts as described above. Thus, the shape of the via hole conductors 506*a* and 506*b* varies due to variation in the cut position when the mother laminate is cut. As a result, the resistance value of the via hole conductors 506*a* and 506*b* varies, and thus the resistance value between the external electrode 504*a* and 504*b* also varies.

SUMMARY

Embodiments consistent with the claimed invention provide an electronic component that allows for obtaining a high inductance value and can reduce variation in a resistance value.

According to an embodiment consistent with the claimed invention, an electronic component includes a plurality of substantially rectangular insulator layers formed as a laminate in a lamination direction. A coil is provided in the laminate in such a manner that a first end of the coil is positioned at an upper side in the lamination direction relative to a second end of the coil. External electrodes are provided at an undersurface of the laminate, and a via hole conductor is provided in the laminate and connects the first end of the coil to one of the external electrodes.

The coil is formed by connecting a plurality of coil conductors that are overlapped with each other to form a substantially annular orbit when viewed in plan view in the lamination direction. The substantially annular orbit is arranged about an intersection of diagonal lines of the insulator layers and is divided into a first orbit portion and a second orbit portion by a straight line parallel to a short side of the rectangular insulator layers.

When an orbit obtained by an axisymmetric movement of the first orbit portion relative to the straight line is defined as a third orbit portion, a part of the second orbit portion is overlapped with a part of the third orbit portion, and a portion of the second orbit portion non overlapped with the third orbit portion is positioned closer to the intersection than a non overlapped portion of the third orbit portion.

The via hole conductor is provided in a region outboard the non overlapped portion of the second orbit portion and inboard an outer side of the non overlapped portion of the third orbit portion.

DETAILED DESCRIPTION

Figure 1:
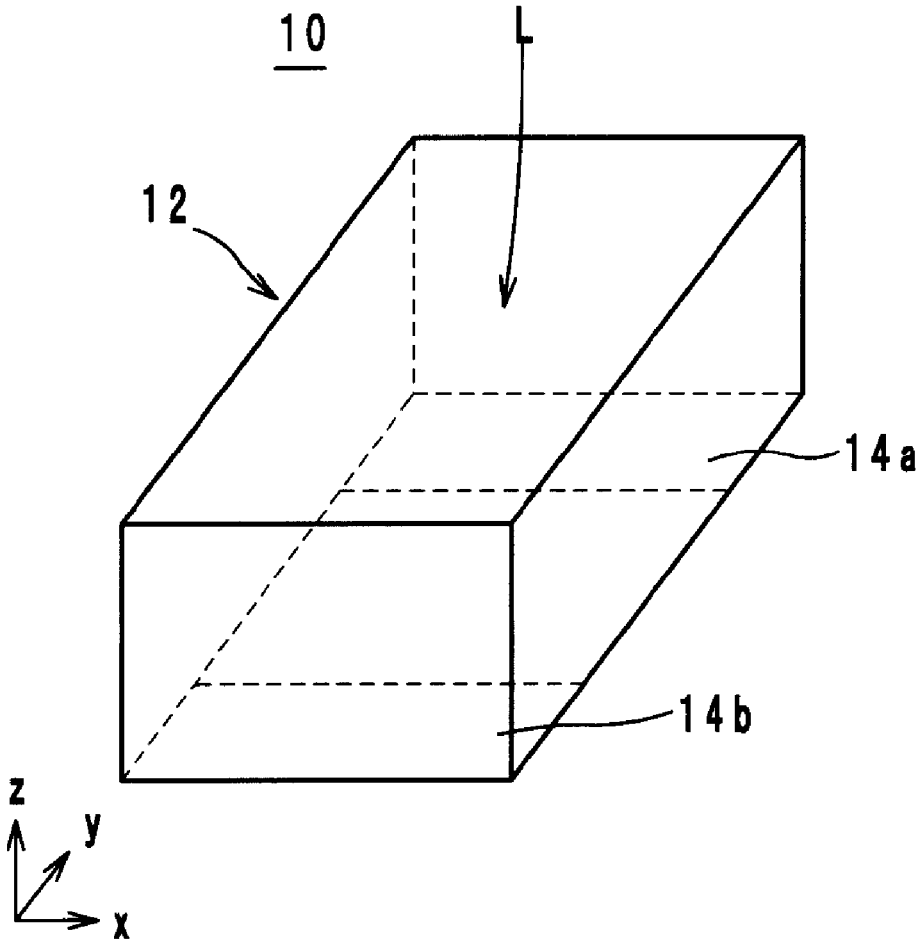
FIG. 1 is a perspective view of an electronic component according to exemplary embodiments.
Figure 2:
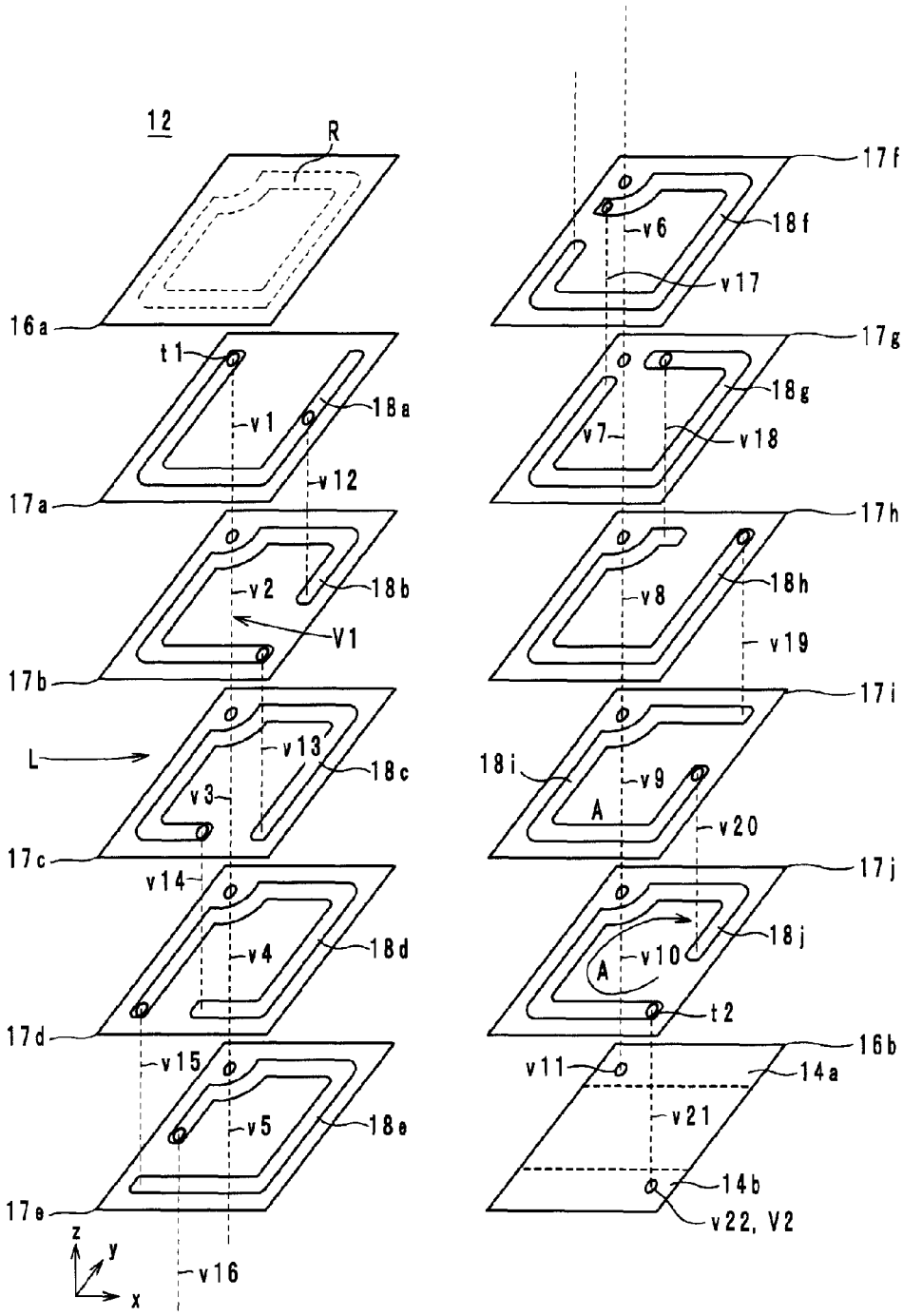
FIG. 2 is an exploded perspective view of a laminate of an electronic component according to an exemplary embodiment.

Hereinafter, an electronic component according to exemplary embodiments will be described with reference to the drawings. FIG. 1 is a perspective view of the electronic component 10 according to embodiments. FIG. 2 is an exploded perspective view of a laminate 12 of an electronic component 10 according to one embodiment. Hereinafter, the lamination direction of the electronic component 10 is defined as the z axis direction or the direction in which insulator layers, described in detail later, are laminated to form the laminate 12. The direction along the short side of the electronic component 10 is defined as the x axis direction, and the direction along the long side of the electronic component 10 is defined as the y axis direction. The x axis, the y axis, and the z axis are orthogonal to each other.

The electronic component 10 has the laminate 12, external electrodes 14*a* and 14*b*, a coil L, and via hole conductors V1 and V2 (not shown in FIG. 1) as shown in FIG. 1 and FIG. 2. The laminate 12 has a substantially rectangular parallelepiped shape and contains the coil L and the via hole conductors V1 and V2.

The external electrodes 14*a* and 14*b* are electrically connected to the coil L through the via hole conductors V1 and V2, respectively and are provided on the bottom surface (undersurface) located on the negative direction side in the z axis direction of the laminate 12. In this embodiment, the external electrode 14*a* is provided along the side located on the positive direction side in the y axis direction on the bottom surface of the laminate 12 and the external electrode 14*b* is provided along the side located on the negative direction side in the y axis direction relative to the external electrode 14*a* on the bottom surface of the laminate 12.

As shown in FIG. 2, the laminate 12 is constituted by laminating insulator layers 16*a*, 17*a* to 17*j*, and 16*b* in this order in the z axis direction. The insulator layers 16*a*, 17*a* to 17*j*, and 16*b* each form a substantially rectangular shape and are formed of magnetic materials containing, for example a Ni—Cu—Zn ferrite.

The coil L is constituted by coil conductors 18*a* to 18*j* and via hole conductors v12 to v20 as shown in FIG. 2. More specifically, the coil L is constituted by connection of the coil conductors 18*a* to 18*j* by the via hole conductors v12 to v20. The coil L has a coil axis extending in the z axis direction and has a spiral shape in which the coil is directed to the positive direction side in the z axis direction while turning in the clockwise direction (the direction of arrow A shown with coil conductor 18*j*). The end t1 of the coil L is positioned on the positive direction side in the z axis direction relative to the end t2 of the coil L.

The coil conductors 18*a* to 18*j* are provided on the insulator layers 17*a* to 17*j*, respectively, as shown in FIG. 2. Each of the coil conductors 18*a* to 18*j* can contain Ag-containing conductive materials, have a number of turns of about ⅞ turn, and can be formed by bending a line conductor. The coil conductor 18*a* has a number of turns of about ¾ turn. More specifically, the coil conductors 18*a* to 18*j* have a shape such that a part of a substantially annular orbit, or ring (¼ in the coil conductor 18*a* and ⅛ in the coil conductors 18*b* to 18*j*) is cut or not present. The coil conductors 18*a* to 18*j* are overlapped with each other to constitute a substantially annular orbit R when viewed in plan view in the z axis, as shown in dashed lines on insulator layer 16*a*. The end t1 of the coil L is the end on the downstream side in the direction of the arrow A of the coil conductor 18*a* and the end t2 of the coil L is the end on the upstream side in the direction of the arrow A of the coil conductor 18*j*.

The via hole conductors v12 to v20 connect the coil conductors 18*a* to 18*j*. More specifically, the via hole conductor v12 connects the position apart from the end t1 of the coil conductor 18*a* by only about ⅝ turn in the direction of the arrow A and the end on the downstream side in the direction of the arrow A of the coil conductor 18*b*. The via hole conductor v13 connects the end on the upstream side in the direction of the arrow A of the coil conductor 18*b* and the end on the downstream side in the direction of the arrow A of the coil conductor 18*c*. The via hole conductor v14 connects the end on the upstream side in the direction of the arrow A of the coil conductor 18*c* and the end on the downstream side in the direction of the arrow A of the coil conductor 18*d*. The via hole conductor v15 connects the end on the upstream side in the direction of the arrow A of the coil conductor 18*d* and the end on the downstream side in the direction of the arrow A of the coil conductor 18*e*. The via hole conductor v16 connects the end on the upstream side in the direction of the arrow A of the coil conductor 18*e* and the end on the downstream side in the direction of the arrow A of the coil conductor 18*f*. The via hole conductor v17 connects the end on the upstream side in the direction of the arrow A of the coil conductor 18*f* and the end on the downstream side in the direction of the arrow A of the coil conductor 18*g*. The via hole conductor v18 connects the end on the upstream side in the direction of the arrow A of the coil conductor 18*g* and the end on the downstream side in the direction of the arrow A of the coil conductor 18*h*. The via hole conductor v19 connects the end on the upstream side in the direction of the arrow A of the coil conductor 18*h* and the end on the downstream side in the direction of the arrow A of the coil conductor 18*i*. The via hole conductor v20 connects the end on the upstream side in the direction of the arrow A of the coil conductor 18*i* and the end on the downstream side in the direction of the arrow A of the coil conductor 18*j*.

As shown in FIG. 2, the via hole conductors v1 to vii penetrate the insulator layers 17*a* to 17*j* and 16*b* in the z axis direction and are connected in a straight line to constitute one via hole conductor V1. The via hole conductor V1 is provided in the laminate 12 and connects the end t1 of the coil L and the external electrode 14*a*. More specifically, the end positioned on the positive direction side in the z axis direction of the via hole conductor V1 is connected to the end on the downstream side in the direction of the arrow A of the coil conductor 18*a* and the end positioned on the negative direction side in the z axis direction of the via hole conductor V1 is connected to the external electrode 14*a*.

Via hole conductors v21 and v22 (V2) penetrate the insulator layers 17*j* and 16*b* in the z axis direction as shown in FIG. 2. The via hole conductors v21 and v22 (V2) are provided in the laminate 12 and connect the end t2 of the coil L and the external electrode 14*b*. More specifically, the end positioned on the positive direction side in the z axis direction of the via hole conductor V2 is connected to the end on the upstream side in the direction of the arrow A of the coil conductor 18*j* and the end positioned on the negative direction side in the z axis direction of the via hole conductor V2 is connected to the external electrode 14*b*.

Next, the positional relationship between the via hole conductor V1 and the orbit R will be described with reference to the drawings. FIG. 3 is a perspective view of the laminate 12 as viewed from the z axis.

Figure 3A:
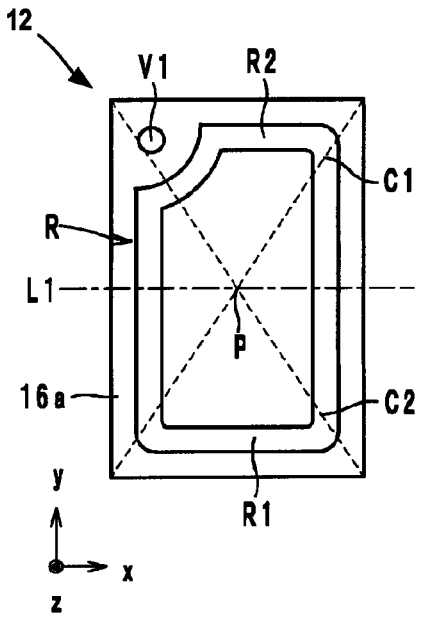
FIG. 3 is a perspective view of a laminate as viewed from the z axis according to an exemplary embodiment.

The via hole conductor V1 is provided at the outside of the orbit R containing the coil conductors 18*a* to 18*j* as shown in FIG. 3A. Thus, the via hole conductor V1 does not pass through the inside of the coil L, and thus does not block the magnetic flux generated by the coil L.

As shown in FIG. 3A, the orbit R passes the intersection of the diagonal lines C1 and C2 of the insulator layer 16*a* and is classified into an orbit portion R1 and an orbit portion R2 by a straight line L1 parallel to the short side of the insulator layer 16*a*. Specifically, in the orbit R, a portion positioned on the negative direction side in the y axis direction relative to the straight line L1 is an orbit portion R1 and a portion positioned on the positive direction side in the y axis direction relative to the straight line L1 is an orbit portion R2. As shown in FIG.

3B, when an orbit obtained by the axisymmetric movement of the orbit portion R1 relative to the straight line L1 is defined as an orbit R3, a part of the orbit portion R2 (hereinafter referred to as an orbit portion r2) is overlapped with a part of the orbit portion R3 (hereinafter referred to as an orbit portion r3). The remaining non overlapped portion (hereinafter referred to as an orbit portion r4) of the orbit portion R2 is positioned closer to the intersection P than the remaining non overlapped portion (hereinafter referred to as an orbit portion r5) of the orbit portion R3. The remaining portions of the orbit portions R2 and R3 (orbit portions r4 and r5) refer to portions other than the orbit portions r2 and r3 in the orbit portions R2 and R3.

Figure 3B:
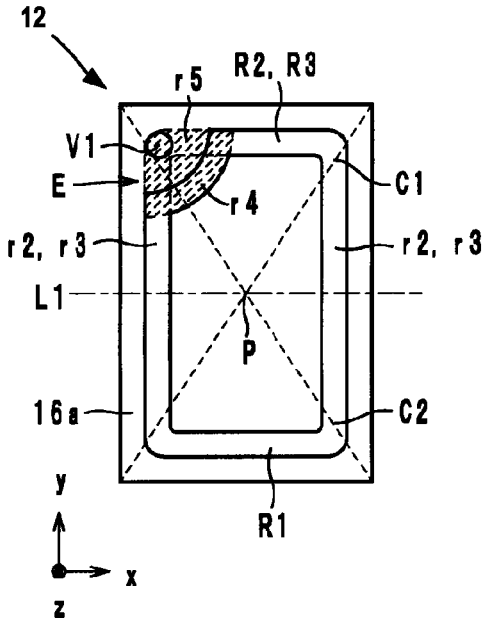

The orbit portions R1 and R3 are combined to form a substantially rectangular orbit as shown in FIG. 3B. The orbit portion r5 constitutes the corner of the substantially rectangular orbit defined by the orbit portions R1 and R3.

As shown in FIG. 3B, the via hole conductor V1 is provided in a region E outboard an outer side of the orbit portion r4 and inboard an outer side of the orbit portion r5 when viewed in plan view from the z axis direction. The via hole conductor V1 is provided at the position overlapping with the orbit portion R2 when viewed from the long side direction (i.e., y axis direction) and the short side direction (i.e., x axis direction) of the insulator layer 16*a*. In this embodiment, the via hole conductor V1 is positioned at the corner constituted by the orbit portion r5 when viewed in plan view from the z axis. The orbit portion r4 forms a substantially arc shape projecting toward the intersection P and forms a substantially arc shape centering on the via hole conductor V1. Thus, as shown in FIG. 2, the maximum proximity distance of the coil conductors 18*b* to 18*f* and 18*h* to 18*j* and the via hole conductor V1 is fixed.

According to the electronic component 10, a high inductance value can be obtained. In more detail, in the electronic component 10, the via hole conductor V1 extends in the z axis direction in the outside of the coil L and does not pass through the inside of the coil L. Therefore, the via hole conductor V1 does not block the magnetic flux passing through the inside of the coil L. Thus, a high inductance value can be obtained in the electronic component 10.

Furthermore, in the electronic component 10, the via hole conductor V1 is provided in a region E surrounded by the orbit portions r4 and r5 when viewed in plan view from the z axis direction as shown in FIG. 3 and is provided at a position overlapping with the orbit portion R2 when viewed in plan view from the long side direction and the short side direction of the insulator layer 16*a*. More specifically, the coil conductors 18*a* to 18*j* draw a substantially rectangular orbit and form a substantially arc shape projecting toward the intersection P of the diagonal lines C1 and C2 only in the vicinity of the via hole conductor V1, thereby avoiding the via hole conductor V1. Thus, each side of the coil conductors 18*a* to 18*j* can be brought close to each side of the insulator layers 17*a* to 17*j* as much as possible and the contact of the via hole conductor V1 and the coil conductors 18*a* to 18*j* can be avoided. Therefore, in the electronic component 10, the coil L can be enlarged, and a high inductance value can be obtained.

Furthermore, in the electronic component 10, variation in the resistance value between the external electrodes 14*a* and 14*b* can be reduced. More specifically, in the multilayer chip inductor 500 described in Japanese Unexamined Patent Application Publication No. 2002-260925, the via hole conductors 506*a* and 506*b* are formed by dividing a substantially cylindrical via hole conductor into two parts as described above. Therefore, the shape of the via hole conductors 506*a* and 506*b* varies due to variation in the cut position when a mother laminate is cut. As a result, the resistance values of the via hole conductors 506*a* and 506*b* vary, and thus the resistance value between the external electrodes 504*a* and 504*b* also varies.

In contrast, in the electronic component 10, the via hole conductor V1 and V2 are not divided. Therefore, in the electronic component 10, the resistance values of the via hole conductors V1 and V2 are hard to vary, and thus the variation in the resistance value between the external electrodes 14*a* and 14*b* can be reduced.

As shown in FIG. 3B, in the electronic component 10, the orbit portion r4 forms a substantially arc shape projecting toward the intersection P and forms a substantially arc shape centering on the via hole conductor V1. Thus, as shown in FIG. 2, the maximum proximity distance of the coil conductors 18*b* to 18*f* and 18*h* to 18*j* and the via hole conductor V1 is fixed. More specifically, in the electronic component 10, the distance between the coil conductors 18*b* to 18*f* and 18*h* to 18*j* and the via hole conductor V1 can be made small while maintaining the insulation state of the coil conductors 18*b* to 18*f* and 18*h* to 18*j* and the via hole conductor V1. As a result, in the electronic component 10, the coil L can be enlarged as much as possible, and a high inductance value can be obtained.

In the electronic component 10, as shown in FIG. 3B, the via hole conductor V1 is positioned at the corner constituted by the orbit portion r5 when viewed in plan view from the z axis. Thus, due to the presence of the via hole conductor V1, the reduction amount of the area of the coil L when viewed in plan view from the z axis can be suppressed to be equal to the area of a substantially sector shape having a central angle of about 90°. Therefore, in the electronic component 10, a high inductance value can be obtained.

(Simulation Result)

Figure 4:
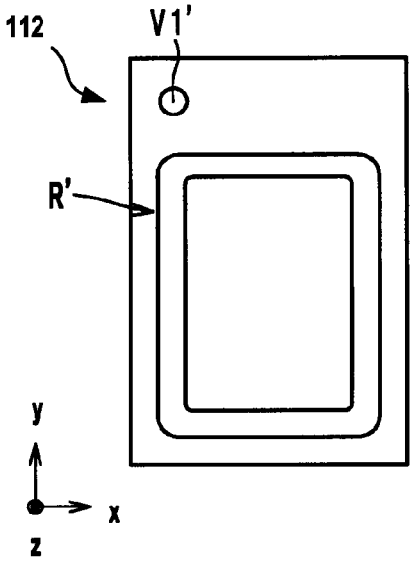
FIG. 4 is a perspective view of a laminate of an electronic component according to a comparative example as viewed from the z axis.

The inventors performed computer simulation described below in order to further clarify the effects demonstrated by the electronic component 10. FIG. 4 is a perspective view from the z axis direction of a laminate 112 of an electronic component according to a comparative example.

The inventors produced a model of the electronic component 10 having the structure shown in FIG. 1 and FIG. 2 as a first model. Moreover, the inventors produced a model of an electronic component having the laminate 112 shown in FIG. 4 as a second model which is a comparative example. As is understood from the comparison between FIGS. 3A and 3B and FIG. 4, the area of the coil L of the first model is larger than that of the second model. Other simulation conditions are as follows: chip size: about 2.5 mm×about 2.0 mm×about 1.1 mm; diameter of via-hole conductor: about 100 μm to about 150 μm; line width of coil conductor: about 250 μm to about 250 μm; thickness of coil conductor: about 20 μm to about 60 μm; number of turns of coil L: about 8.5 turns; maximum proximity distance of via hole conductor V1 and coil L: about 200 μm; area of coil L when viewed in plan view from the z axis: about 1.0 $mm^2$ to About 1.5 $mm^2$; number of insulator layers 16*a:* 10 to 30 layers. For the insulator layers 17*a*, 17*d*, and 17*h*, non-magnetic material layers were used.

Figure 5:
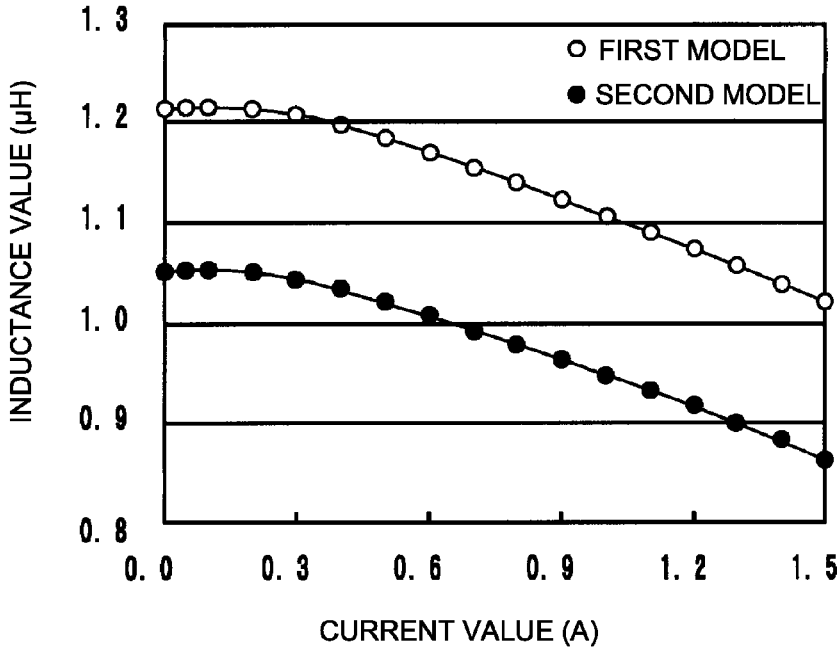
FIG. 5 is a graph showing simulation results.
Figure 6:
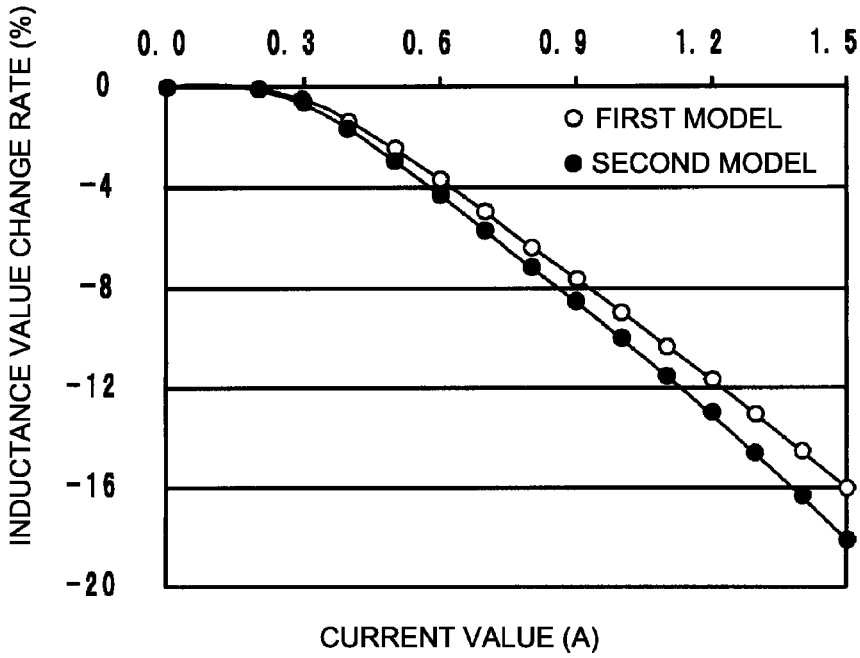
FIG. 6 is a graph showing simulation results.

Using the first model and the second model, the relationship between the current value flowing into the coil L and the inductance value was analyzed. FIG. 5 and FIG. 6 are graphs showing the simulation results. In FIG. 5, the vertical axis represents the inductance value and the horizontal axis represents the current value. In FIG. 6, the vertical axis represents the inductance value change rate and the horizontal axis represents the current value. The inductance value change rate is a value obtained by (Inductance value at each current value−Inductance value at a current value of 0)/Inductance value at a current value of 0×100.

According to the simulation results shown in FIG. 5, a higher inductance value is obtained by the first model rather than by the second model. Therefore, it is found that, in the electronic component 10, a high inductance value can be obtained.

Moreover, the simulation results shown in FIG. 6 show that a reduction in the inductance value change rate when the current value increases is smaller in the first model than in the second model. Therefore, it is found that the direct current superposition characteristics of the first model are superior to those of the second model. This is because it is considered that since the area of the coil L of the first model is larger than the area of the coil L of the second model, it is more difficult for magnetic saturation to occur. Hereinafter, a method for manufacturing the electronic component 10 will be described with reference to the drawings. Hereinafter, a method for manufacturing the electronic component 10 for simultaneously manufacturing a plurality of the electronic components 10 will be described.

First, ceramic green sheets are prepared to serve as the insulator layers 16*a*, 16*b*, and 17*a* to 17*j* of FIG. 2. Specifically, ferric oxide ($Fe_2O_3$), zinc oxide (ZnO), copper oxide (CuO), and nickel oxide (NiO) are weighed in a given ratio, the respective materials are supplied in a ball mill as raw materials, and wet mixing is performed. The obtained mixture is dried and ground, and the obtained powder is calcined at about 800° C. for about 1 hour. The obtained calcined powder is subjected to wet-grinding in a ball mill, dried, and then disintegrated, thereby obtaining ferrite ceramic powder.

To the ferrite ceramic powder, a binding agent (vinyl acetate, water-soluble acryl, and the like), a plasticizer, a wetting material, and a dispersing agent are added, mixed in a ball mill, and degassed by reducing a pressure. The obtained ceramic slurry is formed in a sheet shape on a career sheet by a doctor blade method, and is dried, thereby producing ceramic green sheets to serve as the insulator layers 16*a*, 16*b*, and 17*a* to 17*j*.

Next, as shown in FIG. 2, the via hole conductor v1 to v22 are formed in each of the ceramic green sheets to serve as the insulator layers 17*a* to 17*j* and 16*b*. Specifically, the ceramic green sheets to serve as the insulator layers 17*a* to 17*j* and 16*b* are irradiated with a laser beam to form via holes. Next, the via holes are charged with a conductive paste of Ag, Pd, Cu, Au, alloys thereof, or the like by a printing and coating method or the like.

Next, as shown in FIG. 2, the coil conductors 18*a* to 18*j* are formed on the principal surface (hereinafter referred to as a front surface) on the positive direction side in the z axis direction of the ceramic green sheets to serve as the insulator layers 17*a* to 17*j*. Specifically, on the front surface of the ceramic green sheets to serve as the insulator layers 17*a* to 17*j*, a conductive paste containing Ag, Pd, Cu, Au, alloys thereof, or the like as the main ingredients is applied by a screen-printing method, a photolithographic method, or the like, thereby forming the coil conductors 18*a* to 18*j*. The process for forming the coil conductors 18*a* to 18*j* and the process for charging the via holes with a conductive paste may be performed in the same process.

As shown in FIG. 2, the external electrodes 14*a* and 14*b* are formed on the principal surface (hereinafter referred to as a rear surface) on the negative direction side in the z axis direction of the ceramic green sheet to serve as the insulator layer 16*b*. Specifically, the external electrodes 14*a* and 14*b* are formed by applying a conductive paste containing Ag, Pd, Cu, Au, alloys thereof, or the like as the main ingredients to the rear surface of the ceramic green sheet to serve as the insulator layer 16*b* by a screen-printing method, a photolithographic method, or the like.

Next, as shown in FIG. 2, the ceramic green sheets to serve as the insulator layers 16*a*, 17*a* to 17*j*, and 16*b* are laminated and bonded under a pressure in this order, thereby obtaining a non-calcined mother laminate. In the lamination and bonding under a pressure of the ceramic green sheets to serve as the insulator layers 16*a*, 17*a* to 17*j*, and 16*b*, the ceramic green sheets are laminated one by one and pre-bonded under a pressure to obtain a mother laminate, and then a non-calcined mother laminate is pressurized by isostatic pressing or the like for bonding under a pressure.

Figure 7:
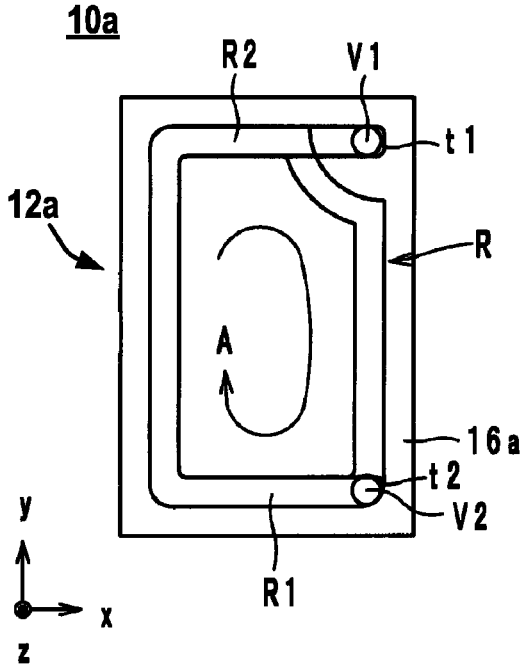
FIG. 7 is a perspective view of a laminate of an electronic component according to a first exemplary modification as viewed from the z axis.

Next, the mother laminate is cut into a laminate 12 having a given dimension (e.g., about 2.5 mm×about 2.0 mm×about 1.1 mm) with a cutting edge. Thus, a non-calcined laminate 12 is obtained. The non-calcined laminate 12 is subjected to binder removal treatment and calcination. The binder removal treatment is performed at about 500° C. in a low oxygen environment for about 2 hours, for example. The calcination is performed at about 800° C. to about 900° C. for about 2.5 hours, for example. By the above-described processes, the electronic component 10 as shown in FIG. 1 is completed. Hereinafter, electronic components 10*a* and 10*b* according to modifications will be described. FIG. 7 is a perspective view from the z axis of a laminate 12*a* of an electronic component 10*a* according to a first exemplary modification.

In the laminate 12*a* shown in FIG. 7, the coil L has a spiral shape in which the coil is directed to the positive direction side in the z axis direction while turning in the clockwise direction (the direction of the arrow A) in the same manner as in the coil L of the electronic component 10. Then, as shown in FIG. 7, the end t1 of the coil L is positioned at the corner on the positive direction side in the x axis direction and on the positive direction side in the y axis direction. In contrast, as shown in FIG. 7, the end t2 of the coil L is positioned at the corner on the positive direction side in the x axis direction and on the negative direction side in the y axis direction. More specifically, the end t1 is provided at the corner at the farthest position in the direction of the arrow A as viewed from the end t2. Thus, the distance between the end t1 and the end t2 can be enlarged, and thus the number of turns of the coil L can be increased.

Figure 8:
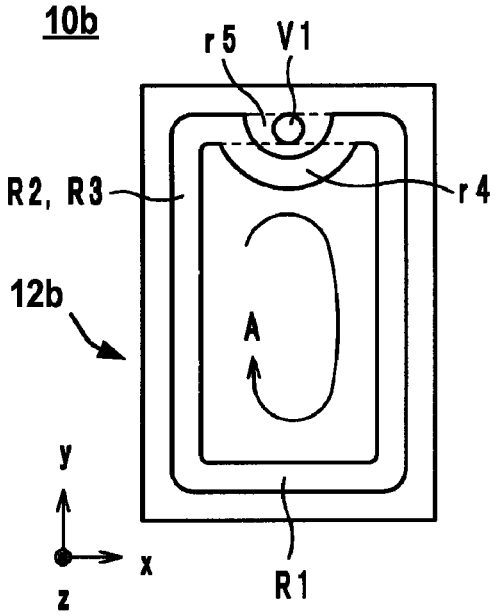
FIG. 8 is a perspective view of a laminate of an electronic component according to a second exemplary modification as viewed from the z axis.
Figure 9:
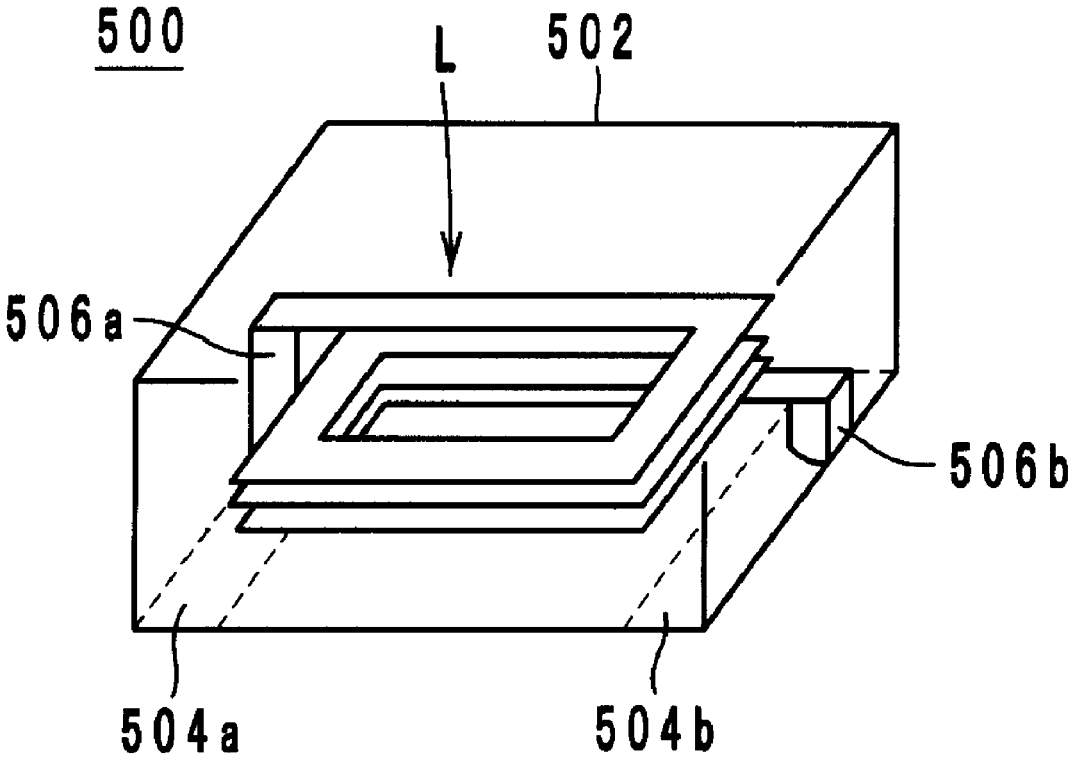
FIG. 9 Prior Art
FIG. 9 is a perspective view of a conventional multilayer chip inductor.

FIG. 8 is a perspective view from the z axis direction of a laminate 12*b* of an electronic component 10*b* according to a second modification. As shown in FIG. 8, the orbit portion r4 may be provided not at the corner but on the short side on a substantially rectangular orbit constituted by the orbit portions R1 and R3. In this case, the orbit portion r4 draws a semi-circular orbit portion centering on the via hole conductor V1. Although not shown, the orbit portion r4 may be provided on the long side on a substantially rectangular orbit constituted by the orbit portions R1 and R3. In this case, the external electrode 14*a* is provided on the bottom surface of the laminate 12*a* along the side positioned on the negative direction side in the x axis direction and the external electrode 14*b* is provided on the bottom surface of the laminate 12*a* along the side positioned on the positive direction side in the x axis direction.

In the electronic components 10, 10*a*, and 10*b*, the orbit constituted by the orbit portions R1 and R3 have a substantially rectangular shape. However, the shape of the orbit constituted by the orbit portions R1 and R3 is not limited to a substantially rectangular shape.

The orbit portion r4 forms a substantially arc shape. However, the orbit portion r4 may not be a substantially arc shape and may be constituted by combination of straight lines.

Embodiments consistent with the claimed invention are useful for electronic components, and are particularly excellent in the respect that a high inductance value can be obtained and that variation in a resistance value can be reduced.

Although a limited number of embodiments are described herein, one of ordinary skill in the art will readily recognize that there could be variations to any of these embodiments and those variations would be within the scope of the appended claims. Thus, it will be apparent to those skilled in the art that various changes and modifications can be made to the electronic component described herein without departing from the scope of the appended claims and their equivalents.

What is claimed is:

1. An electronic component, comprising:

a plurality of substantially rectangular insulator layers formed as a laminate in a lamination direction;

a coil provided in the laminate, said coil including a first end positioned at an upper side of the laminate in the lamination direction relative to a second end of the coil;

external electrodes provided at an undersurface of the laminate; and a via hole conductor provided in the laminate and connecting the first end and one of the external electrodes, wherein the coil is formed by connecting a plurality of coil conductors that are overlapped with each other to form a substantially annular orbit when viewed in plan view in the lamination direction;

the substantially annular orbit is arranged about an intersection of diagonal lines of the insulator layers and is divided into a first orbit portion and a second orbit portion by a straight line parallel to a short side of the rectangular insulator layers, wherein with an orbit obtained by axisymmetric movement of the first orbit portion relative to the straight line defined as a third orbit portion, said third orbit portion not present in the final device structure, a part of the second orbit portion is overlapped with a part of the third orbit portion, and a portion of the second orbit portion non overlapped with the third orbit portion is positioned closer to the intersection than a non overlapped portion of the third orbit portion, and the via hole conductor is provided in a region outboard the non overlapped portion of the second orbit portion and inboard an outer side of the non overlapped portion of the third orbit portion.

2. The electronic component according to claim 1, wherein the via hole conductor is provided at a position overlapping with the second orbit portion when viewed from a long side direction and a short side direction of the insulator layers.

3. The electronic component according to claim 1, wherein the first orbit portion and the third orbit portion are combined to form a substantially rectangular orbit.

4. The electronic component according to claim 3, wherein the non overlapping portion of the third orbit portion forms a corner of the substantially rectangular orbit.

5. The electronic component according to claim 4, wherein the coil has a spiral shape in which the coil is directed upward in a lamination direction while turning in a given direction; and the second end is provided at a corner at the farthest position in a given direction as viewed from the first end.

6. The electronic component according to claim 1, wherein the remaining portion of the second orbit portion forms a substantially arc shape centering on the via hole conductor.

7. The electronic component according to claim 2, wherein the remaining portion of the second orbit portion forms a substantially arc shape centering on the via hole conductor.

8. The electronic component according to claim 3, wherein the remaining portion of the second orbit portion forms a substantially arc shape centering on the via hole conductor.

9. The electronic component according to claim 4, wherein the remaining portion of the second orbit portion forms a substantially arc shape centering on the via hole conductor.

10. The electronic component according to claim 5, wherein the remaining portion of the second orbit portion forms a substantially arc shape centering on the via hole conductor.

* * * * *